US009564120B2

(12) United States Patent
Stefan et al.

(10) Patent No.: US 9,564,120 B2
(45) Date of Patent: Feb. 7, 2017

(54) SPEECH ADAPTATION IN SPEECH SYNTHESIS

(75) Inventors: Jeffrey M. Stefan, Clawson, MI (US); Gaurav Talwar, Farmington Hills, MI (US); Rathinavelu Chengalvarayan, Naperville, IL (US)

(73) Assignee: General Motors LLC, Detroit, MI (US)

( * ) Notice: Subject to any disclaimer, the term of this patent is extended or adjusted under 35 U.S.C. 154(b) by 908 days.

(21) Appl. No.: 12/780,402

(22) Filed: May 14, 2010

(65) Prior Publication Data

US 2011/0282668 A1 Nov. 17, 2011

(51) Int. Cl.

| | |
|---|---|
| ***G10L 13/00*** | (2006.01) |
| ***G10L 13/033*** | (2013.01) |
| *G10L 21/013* | (2013.01) |

(52) U.S. Cl.

CPC ..... *G10L 13/033* (2013.01); *G10L 2021/0135* (2013.01)

(58) Field of Classification Search

CPC ..... G10L 13/00; G10L 13/02; G10L 13/033; G10L 13/043; G10L 15/265; G10L 13/10; G10L 21/00; G10L 2021/0135; G10L 13/027; G10L 15/06; G10L 15/32; G10L 15/34

USPC ..... 704/260, 258, 251, 256.1, 200.1, 269, 704/278, E21.001, E21.002, E15.004

See application file for complete search history.

(56) References Cited

U.S. PATENT DOCUMENTS

| | | | | |
|---|---|---|---|---|
| 6,012,028 | A * | 1/2000 | Kubota | G10L 13/02 434/130 |
| 6,334,103 | B1 * | 12/2001 | Surace et al. | 704/257 |
| 6,708,153 | B2 * | 3/2004 | Brittan et al. | 704/260 |
| 7,565,293 | B1 * | 7/2009 | Fuhrmann et al. | 704/260 |
| 7,668,718 | B2 * | 2/2010 | Kahn et al. | 704/270 |
| 7,693,719 | B2 * | 4/2010 | Chu et al. | 704/270.1 |
| 8,949,125 | B1 * | 2/2015 | Chechik | G10L 13/02 701/409 |
| 2002/0077819 | A1 * | 6/2002 | Girardo | 704/260 |
| 2003/0163316 | A1 * | 8/2003 | Addison | G09B 5/04 704/260 |
| 2004/0054534 | A1 * | 3/2004 | Junqua | 704/258 |
| 2004/0111271 | A1 * | 6/2004 | Tischer | G10L 13/033 704/277 |
| 2004/0122668 | A1 * | 6/2004 | Marino et al. | 704/249 |
| 2004/0176954 | A1 * | 9/2004 | Wang | 704/254 |
| 2005/0283365 | A1 * | 12/2005 | Mizutani et al. | 704/257 |
| 2006/0069567 | A1 * | 3/2006 | Tischer | G10L 13/033 704/260 |
| 2006/0074672 | A1 * | 4/2006 | Allefs | 704/258 |
| 2006/0095265 | A1 * | 5/2006 | Chu et al. | 704/268 |
| 2006/0129409 | A1 * | 6/2006 | Mizutani et al. | 704/275 |
| 2006/0136227 | A1 * | 6/2006 | Mizutani et al. | 704/277 |

(Continued)

FOREIGN PATENT DOCUMENTS

| | | |
|---|---|---|
| CN | 101178895 | 5/2008 |
| CN | 101359473 | 2/2009 |

*Primary Examiner* — Abdelali Serrou

(74) *Attorney, Agent, or Firm* — Christopher DeVries; Reising Ethington P.C.

(57) ABSTRACT

A method of and system for speech synthesis. First and second text inputs are received in a text-to-speech system, and processed into respective first and second speech outputs corresponding to stored speech respectively from first and second speakers using a processor of the system. The second speech output of the second speaker is adapted to sound like the first speech output of the first speaker.

16 Claims, 3 Drawing Sheets

(56) References Cited

U.S. PATENT DOCUMENTS

| | | | | |
|---|---|---|---|---|
| 2006/0149558 | A1* | 7/2006 | Kahn et al. | 704/278 |
| 2007/0118378 | A1* | 5/2007 | Skuratovsky | G10L 13/033 704/260 |
| 2007/0203702 | A1* | 8/2007 | Hirose et al. | 704/256 |
| 2008/0004879 | A1* | 1/2008 | Huang | 704/270 |
| 2008/0195391 | A1* | 8/2008 | Marple | G10L 13/10 704/260 |
| 2008/0291325 | A1* | 11/2008 | Teegan et al. | 348/552 |
| 2009/0037179 | A1* | 2/2009 | Liu et al. | 704/260 |
| 2009/0055162 | A1* | 2/2009 | Qian et al. | 704/8 |
| 2009/0326948 | A1* | 12/2009 | Agarwal | G10L 13/033 704/260 |
| 2010/0153108 | A1* | 6/2010 | Szalai et al. | 704/243 |
| 2010/0153116 | A1* | 6/2010 | Szalai et al. | 704/260 |
| 2010/0161327 | A1* | 6/2010 | Chandra et al. | 704/235 |
| 2010/0198577 | A1* | 8/2010 | Chen et al. | 704/2 |
| 2010/0223005 | A1* | 9/2010 | Odinak et al. | 701/202 |
| 2010/0318362 | A1* | 12/2010 | Kurzweil | G10L 13/00 704/260 |
| 2012/0150543 | A1* | 6/2012 | Teegan et al. | 704/260 |

* cited by examiner

SPEECH ADAPTATION IN SPEECH SYNTHESIS

TECHNICAL FIELD

The present invention relates generally to speech signal processing and, more particularly, to speech synthesis.

BACKGROUND OF THE INVENTION

Speech synthesis is the production of speech from text by artificial means. For example, text-to-speech (TTS) systems synthesize speech from text to provide an alternative to conventional computer-to-human visual output devices like computer monitors or displays. There are many varieties of TTS synthesis, including formant TTS synthesis and concatenative TTS synthesis. Formant TTS synthesis does not output recorded human speech and, instead, outputs computer generated audio that tends to sound artificial and robotic. In concatenative TTS synthesis, segments of stored human speech are concatenated and output to produce smoother, more natural sounding speech.

A TTS system may include the following basic elements. A source of raw text includes words, numbers, symbols, abbreviations, and/or punctuation to be synthesized into speech. A speech database includes pre-recorded speech from one or more people. A pre-processor converts the raw text into an output that is the equivalent of written words. A synthesis engine phonetically transcribes the pre-processor output and converts the pre-processor output into appropriate language units like sentences, clauses, and/or phrases. A unit selector selects units of speech from the speech database that best correspond to the language units from the synthesis engine. An acoustic interface converts the selected units of speech into audio signals, and a loudspeaker converts the audio signals to audible speech.

One problem encountered with TTS synthesis is that some applications may use speech recorded from different people having significantly different voices. For example, TTS-enabled vehicle navigation systems use voice guidance having a multiple part syntax that may include a directional maneuver utterance (e.g. "Perform legal U-turn onto . . . ") and a street name utterance (e.g. " . . . North Telegraph Road.") The maneuver utterance may be generated from a first speaker of a navigation service provider, and the street name utterance may be generated from a second speaker of a map data provider. When the utterances are played together during voice guidance, the combined utterance may sound unpleasant to a user. For example, the user may perceive the transition from the maneuver utterance to the street name utterance, for example, because of the difference in prosody between the speakers.

SUMMARY OF THE INVENTION

According to one aspect of the invention, there is provided a method of speech synthesis. The method comprises the steps of (a) receiving first and second text inputs in a text-to-speech system, (b) processing the first and second text inputs into respective first and second speech outputs corresponding to stored speech respectively from first and second speakers using a processor of the system, and (c) adapting the second speech output of the second speaker to sound like the first speech output of the first speaker.

According to another aspect of the invention, there is provided a computer program product including instructions on a computer readable medium and executable by a computer processor of a text-to-speech system to cause the system to implement the aforementioned steps.

According to an additional aspect of the invention, there is provided a speech synthesis system including first and second sources of text, a first speech database including pre-recorded speech from a first speaker, a second speech database including pre-recorded speech from a second speaker, and a pre-processor to convert text into synthesizable output. The system also includes a processor to convert first and second text inputs from the first and second sources of text into respective first and second speech outputs corresponding to the pre-recorded speech respectively from the first and second speakers, and a post-processor to adapt the second speech output of the second speaker to sound like the first speech output of the first speaker.

BRIEF DESCRIPTION OF THE DRAWINGS

One or more preferred exemplary embodiments of the invention will hereinafter be described in conjunction with the appended drawings, wherein like designations denote like elements, and wherein.

DETAILED DESCRIPTION OF THE PREFERRED EMBODIMENT(S)

The following description describes an example communications system, an example text-to-speech (TTS) system that can be used with the communications system, and one or more example methods that can be used with one or both of the aforementioned systems. The methods described below can be used by a vehicle telematics unit (VTU) as a part of synthesizing speech for output to a user of the VTU. Although the methods described below are such as they might be implemented for a VTU in a navigational context during program execution or runtime, it will be appreciated that they could be useful in any type of TTS system and other types of TTS systems and for contexts other than the navigational context. In one specific example, the methods may be used not only during program runtime, but also or instead may be used upstream in training a TTS system before the system or program is activated for use by a user.

Communications System—

Figure 1:
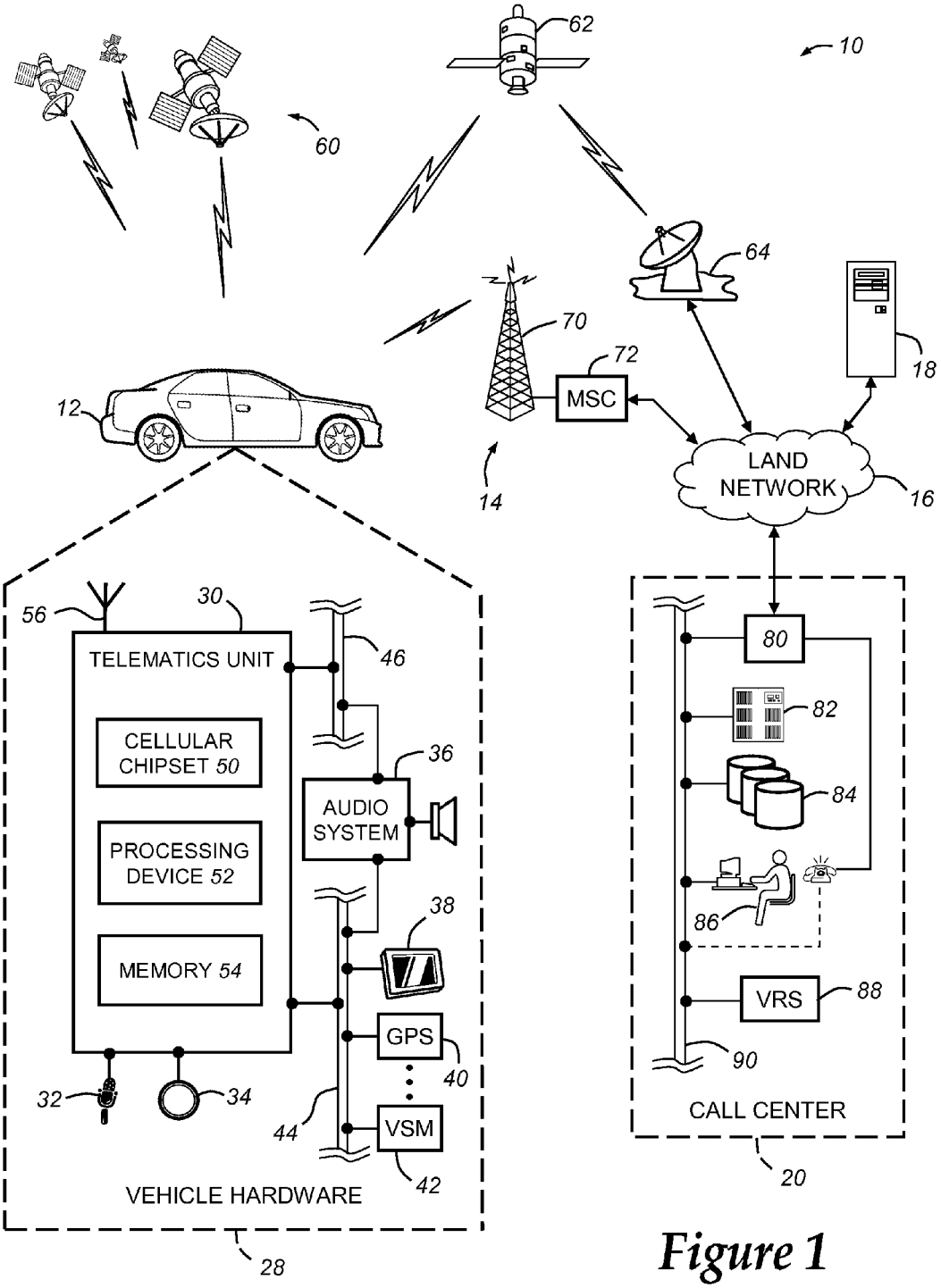
FIG. 1 is a block diagram depicting an exemplary embodiment of a communications system that is capable of utilizing the method disclosed herein.

With reference to FIG. 1, there is shown an exemplary operating environment that comprises a mobile vehicle communications system 10 and that can be used to implement the method disclosed herein. Communications system 10 generally includes a vehicle 12, one or more wireless carrier systems 14, a land communications network 16, a computer 18, and a call center 20. It should be understood that the disclosed method can be used with any number of different systems and is not specifically limited to the operating environment shown here. Also, the architecture, construction, setup, and operation of the system 10 and its individual components are generally known in the art. Thus, the following paragraphs simply provide a brief overview of one such exemplary system 10; however, other systems not shown here could employ the disclosed method as well.

Vehicle 12 is depicted in the illustrated embodiment as a passenger car, but it should be appreciated that any other vehicle including motorcycles, trucks, sports utility vehicles (SUVs), recreational vehicles (RVs), marine vessels, aircraft, etc., can also be used. Some of the vehicle electronics 28 is shown generally in FIG. 1 and includes a telematics unit 30, a microphone 32, one or more pushbuttons or other control inputs 34, an audio system 36, a visual display 38, and a GPS module 40 as well as a number of vehicle system modules (VSMs) 42. Some of these devices can be connected directly to the telematics unit such as, for example, the microphone 32 and pushbutton(s) 34, whereas others are indirectly connected using one or more network connections, such as a communications bus 44 or an entertainment bus 46. Examples of suitable network connections include a controller area network (CAN), a media oriented system transfer (MOST), a local interconnection network (LIN), a local area network (LAN), and other appropriate connections such as Ethernet or others that conform with known ISO, SAE and IEEE standards and specifications, to name but a few.

Telematics unit 30 is an OEM-installed device that enables wireless voice and/or data communication over wireless carrier system 14 and via wireless networking so that the vehicle can communicate with call center 20, other telematics-enabled vehicles, or some other entity or device. The telematics unit preferably uses radio transmissions to establish a communications channel (a voice channel and/or a data channel) with wireless carrier system 14 so that voice and/or data transmissions can be sent and received over the channel. By providing both voice and data communication, telematics unit 30 enables the vehicle to offer a number of different services including those related to navigation, telephony, emergency assistance, diagnostics, infotainment, etc. Data can be sent either via a data connection, such as via packet data transmission over a data channel, or via a voice channel using techniques known in the art. For combined services that involve both voice communication (e.g., with a live advisor or voice response unit at the call center 20) and data communication (e.g., to provide GPS location data or vehicle diagnostic data to the call center 20), the system can utilize a single call over a voice channel and switch as needed between voice and data transmission over the voice channel, and this can be done using techniques known to those skilled in the art.

According to one embodiment, telematics unit 30 utilizes cellular communication according to either GSM or CDMA standards and thus includes a standard cellular chipset 50 for voice communications like hands-free calling, a wireless modem for data transmission, an electronic processing device 52, one or more digital memory devices 54, and a dual antenna 56. It should be appreciated that the modem can either be implemented through software that is stored in the telematics unit and is executed by processor 52, or it can be a separate hardware component located internal or external to telematics unit 30. The modem can operate using any number of different standards or protocols such as EVDO, CDMA, GPRS, and EDGE. Wireless networking between the vehicle and other networked devices can also be carried out using telematics unit 30. For this purpose, telematics unit 30 can be configured to communicate wirelessly according to one or more wireless protocols, such as any of the IEEE 802.11 protocols, WiMAX, or Bluetooth. When used for packet-switched data communication such as TCP/IP, the telematics unit can be configured with a static IP address or can set up to automatically receive an assigned IP address from another device on the network such as a router or from a network address server.

Processor 52 can be any type of device capable of processing electronic instructions including microprocessors, microcontrollers, host processors, controllers, vehicle communication processors, and application specific integrated circuits (ASICs). It can be a dedicated processor used only for telematics unit 30 or can be shared with other vehicle systems. Processor 52 executes various types of digitally-stored instructions, such as software or firmware programs stored in memory 54, which enable the telematics unit to provide a wide variety of services. For instance, processor 52 can execute programs or process data to carry out at least a part of the method discussed herein.

Telematics unit 30 can be used to provide a diverse range of vehicle services that involve wireless communication to and/or from the vehicle. Such services include: turn-by-turn directions and other navigation-related services that are provided in conjunction with the GPS-based vehicle navigation module 40; airbag deployment notification and other emergency or roadside assistance-related services that are provided in connection with one or more collision sensor interface modules such as a body control module (not shown); diagnostic reporting using one or more diagnostic modules; and infotainment-related services where music, webpages, movies, television programs, video games and/or other information is downloaded by an infotainment module (not shown) and is stored for current or later playback. The above-listed services are by no means an exhaustive list of all of the capabilities of telematics unit 30, but are simply an enumeration of some of the services that the telematics unit is capable of offering. Furthermore, it should be understood that at least some of the aforementioned modules could be implemented in the form of software instructions saved internal or external to telematics unit 30, they could be hardware components located internal or external to telematics unit 30, or they could be integrated and/or shared with each other or with other systems located throughout the vehicle, to cite but a few possibilities. In the event that the modules are implemented as VSMs 42 located external to telematics unit 30, they could utilize vehicle bus 44 to exchange data and commands with the telematics unit.

GPS module 40 receives radio signals from a constellation 60 of GPS satellites. From these signals, the module 40 can determine vehicle position that is used for providing navigation and other position-related services to the vehicle driver. Navigation information can be presented on the display 38 (or other display within the vehicle) or can be presented verbally such as is done when supplying turn-by-turn navigation. The navigation services can be provided using a dedicated in-vehicle navigation module (which can be part of GPS module 40), or some or all navigation services can be done via telematics unit 30, wherein the position information is sent to a remote location for purposes of providing the vehicle with navigation maps, map annotations (points of interest, restaurants, etc.), route calculations, and the like. The position information can be supplied to call center 20 or other remote computer system, such as computer 18, for other purposes, such as fleet management. Also, new or updated map data can be downloaded to the GPS module 40 from the call center 20 via the telematics unit 30.

Apart from the audio system 36 and GPS module 40, the vehicle 12 can include other vehicle system modules (VSMs) 42 in the form of electronic hardware components that are located throughout the vehicle and typically receive input from one or more sensors and use the sensed input to perform diagnostic, monitoring, control, reporting and/or other functions. Each of the VSMs 42 is preferably connected by communications bus 44 to the other VSMs, as well as to the telematics unit 30, and can be programmed to run vehicle system and subsystem diagnostic tests. As examples, one VSM 42 can be an engine control module (ECM) that controls various aspects of engine operation such as fuel ignition and ignition timing, another VSM 42 can be a powertrain control module that regulates operation of one or more components of the vehicle powertrain, and another VSM 42 can be a body control module that governs various electrical components located throughout the vehicle, like the vehicle's power door locks and headlights. According to one embodiment, the engine control module is equipped with on-board diagnostic (OBD) features that provide myriad real-time data, such as that received from various sensors including vehicle emissions sensors, and provide a standardized series of diagnostic trouble codes (DTCs) that allow a technician to rapidly identify and remedy malfunctions within the vehicle. As is appreciated by those skilled in the art, the above-mentioned VSMs are only examples of some of the modules that may be used in vehicle 12, as numerous others are also possible.

Vehicle electronics 28 also includes a number of vehicle user interfaces that provide vehicle occupants with a means of providing and/or receiving information, including microphone 32, pushbuttons(s) 34, audio system 36, and visual display 38. As used herein, the term 'vehicle user interface' broadly includes any suitable form of electronic device, including both hardware and software components, which is located on the vehicle and enables a vehicle user to communicate with or through a component of the vehicle. Microphone 32 provides audio input to the telematics unit to enable the driver or other occupant to provide voice commands and carry out hands-free calling via the wireless carrier system 14. For this purpose, it can be connected to an on-board automated voice processing unit utilizing human-machine interface (HMI) technology known in the art. The pushbutton(s) 34 allow manual user input into the telematics unit 30 to initiate wireless telephone calls and provide other data, response, or control input. Separate pushbuttons can be used for initiating emergency calls versus regular service assistance calls to the call center 20. Audio system 36 provides audio output to a vehicle occupant and can be a dedicated, stand-alone system or part of the primary vehicle audio system. According to the particular embodiment shown here, audio system 36 is operatively coupled to both vehicle bus 44 and entertainment bus 46 and can provide AM, FM and satellite radio, CD, DVD and other multimedia functionality. This functionality can be provided in conjunction with or independent of the infotainment module described above. Visual display 38 is preferably a graphics display, such as a touch screen on the instrument panel or a heads-up display reflected off of the windshield, and can be used to provide a multitude of input and output functions. Various other vehicle user interfaces can also be utilized, as the interfaces of FIG. 1 are only an example of one particular implementation.

Wireless carrier system 14 is preferably a cellular telephone system that includes a plurality of cell towers 70 (only one shown), one or more mobile switching centers (MSCs) 72, as well as any other networking components required to connect wireless carrier system 14 with land network 16. Each cell tower 70 includes sending and receiving antennas and a base station, with the base stations from different cell towers being connected to the MSC 72 either directly or via intermediary equipment such as a base station controller. Cellular system 14 can implement any suitable communications technology, including for example, analog technologies such as AMPS, or the newer digital technologies such as CDMA (e.g., CDMA2000) or GSM/GPRS. As will be appreciated by those skilled in the art, various cell tower/base station/MSC arrangements are possible and could be used with wireless system 14. For instance, the base station and cell tower could be co-located at the same site or they could be remotely located from one another, each base station could be responsible for a single cell tower or a single base station could service various cell towers, and various base stations could be coupled to a single MSC, to name but a few of the possible arrangements.

Apart from using wireless carrier system 14, a different wireless carrier system in the form of satellite communication can be used to provide uni-directional or bi-directional communication with the vehicle. This can be done using one or more communication satellites 62 and an uplink transmitting station 64. Uni-directional communication can be, for example, satellite radio services, wherein programming content (news, music, etc.) is received by transmitting station 64, packaged for upload, and then sent to the satellite 62, which broadcasts the programming to subscribers. Bi-directional communication can be, for example, satellite telephony services using satellite 62 to relay telephone communications between the vehicle 12 and station 64. If used, this satellite telephony can be utilized either in addition to or in lieu of wireless carrier system 14.

Land network 16 may be a conventional land-based telecommunications network that is connected to one or more landline telephones and connects wireless carrier system 14 to call center 20. For example, land network 16 may include a public switched telephone network (PSTN) such as that used to provide hardwired telephony, packet-switched data communications, and the Internet infrastructure. One or more segments of land network 16 could be implemented through the use of a standard wired network, a fiber or other optical network, a cable network, power lines, other wireless networks such as wireless local area networks (WLANs), or networks providing broadband wireless access (BWA), or any combination thereof. Furthermore, call center 20 need not be connected via land network 16, but could include wireless telephony equipment so that it can communicate directly with a wireless network, such as wireless carrier system 14.

Computer 18 can be one of a number of computers accessible via a private or public network such as the Internet. Each such computer 18 can be used for one or more purposes, such as a web server accessible by the vehicle via telematics unit 30 and wireless carrier 14. Other such accessible computers 18 can be, for example: a service center computer where diagnostic information and other vehicle data can be uploaded from the vehicle via the telematics unit 30; a client computer used by the vehicle owner or other subscriber for such purposes as accessing or receiving vehicle data or to setting up or configuring subscriber preferences or controlling vehicle functions; or a third party repository to or from which vehicle data or other information is provided, whether by communicating with the vehicle 12 or call center 20, or both. A computer 18 can also be used for providing Internet connectivity such as DNS services or as a network address server that uses DHCP or other suitable protocol to assign an IP address to the vehicle 12.

Call center 20 is designed to provide the vehicle electronics 28 with a number of different system back-end functions and, according to the exemplary embodiment shown here, generally includes one or more switches 80, servers 82, databases 84, live advisors 86, as well as an automated voice response system (VRS) 88, all of which are known in the art. These various call center components are preferably coupled to one another via a wired or wireless local area network 90. Switch 80, which can be a private branch exchange (PBX) switch, routes incoming signals so that voice transmissions are usually sent to either the live adviser 86 by regular phone or to the automated voice response system 88 using VoIP. The live advisor phone can also use VoIP as indicated by the broken line in FIG. 1. VoIP and other data communication through the switch 80 is implemented via a modem (not shown) connected between the switch 80 and network 90. Data transmissions are passed via the modem to server 82 and/or database 84. Database 84 can store account information such as subscriber authentication information, vehicle identifiers, profile records, behavioral patterns, and other pertinent subscriber information. Data transmissions may also be conducted by wireless systems, such as 802.11x, GPRS, and the like. Although the illustrated embodiment has been described as it would be used in conjunction with a manned call center 20 using live advisor 86, it will be appreciated that the call center can instead utilize VRS 88 as an automated advisor or, a combination of VRS 88 and the live advisor 86 can be used.

Speech Synthesis System—

Figure 2:
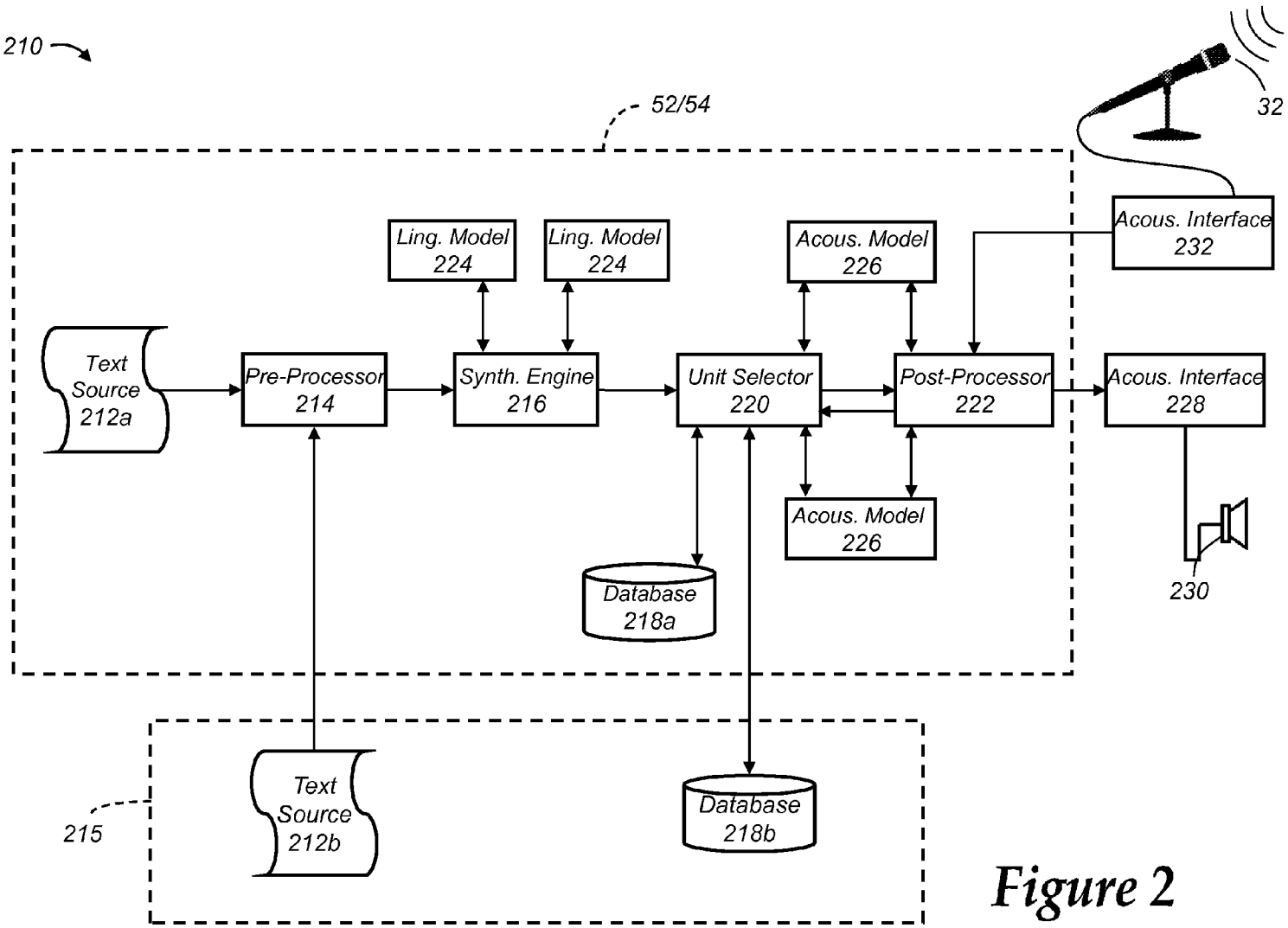
FIG. 2 is a block diagram illustrating an exemplary embodiment of an TTS system that can be used with the system of FIG. 1 and used to implement exemplary methods of speech synthesis.

Turning now to FIG. 2, there is shown an exemplary architecture for a text-to-speech (TTS) system 210 that can be used to enable the presently disclosed method. In general, a user or vehicle occupant may interact with a TTS system to receive instructions from or listen to menu prompts of an application, for example, a vehicle navigation application, a hands free calling application, or the like. Generally, a TTS system extracts output words or identifiers from a source of text, converts the output into appropriate language units, selects stored units of speech that best correspond to the language units, converts the selected units of speech into audio signals, and outputs the audio signals as audible speech for interfacing with a user.

TTS systems are generally known to those skilled in the art, as described in the background section. But FIG. 2 illustrates an example of an improved TTS system according to the present disclosure. According to one embodiment, some or all of the system 210 can be resident on, and processed using, the telematics unit 30 of FIG. 1. According to an alternative exemplary embodiment, some or all of the TTS system 210 can be resident on, and processed using, computing equipment in a location remote from the vehicle 12, for example, the call center 20. For instance, linguistic models, acoustic models, and the like can be stored in memory of one of the servers 82 and/or databases 84 in the call center 20 and communicated to the vehicle telematics unit 30 for in-vehicle TTS processing. Similarly, TTS software can be processed using processors of one of the servers 82 in the call center 20. In other words, the TTS system 210 can be resident in the telematics unit 30 or distributed across the call center 20 and the vehicle 12 in any desired manner.

The system 210 can include one or more text sources 212*a*, 212*b*, and a memory, for example the telematics memory 54, for storing text from the text sources 212*a*, 212*b* and storing TTS software and data. The system 210 can also include a processor, for example the telematics processor 52, to process the text and function with the memory and in conjunction with the following system modules. A pre-processor 214 receives text from the text sources 212*a*, 212*b* and converts the text into suitable words or the like. A synthesis engine 216 converts the output from the pre-processor 214 into appropriate language units like phrases, clauses, and/or sentences. One or more speech databases 218*a*, 218*b* store recorded speech. A unit selector 220 selects units of stored speech from the databases 218*a*, 218*b* that best correspond to the output from the synthesis engine 216. A post-processor 222 modifies or adapts one or more of the selected units of stored speech. One or more or linguistic models 224 are used as input to the synthesis engine 216, and one or more acoustic models 226 are used as input to the unit selector 220. The system 210 also can include an acoustic interface 228 to convert the selected units of speech into audio signals and a loudspeaker 230, for example of the telematics audio system, to convert the audio signals to audible speech. The system 210 further can include a microphone, for example the telematics microphone 32, and an acoustic interface 232 to digitize speech into acoustic data for use as feedback to the post-processor 222.

The text sources 212*a*, 212*b* can be in any suitable medium and can include any suitable content. For example, the text sources 212*a*, 212*b* can be one or more scanned documents, text files or application data files, or any other suitable computer files, or the like. The text sources 212*a*, 212*b* can include words, numbers, symbols, and/or punctuation to be synthesized into speech and for output to the text converter 214. Any suitable quantity of text sources can be used. But in one exemplary embodiment, a first text source 212*a* can be from a first service provider and the second text source 212*b* can be from a second service provider. For instance, the first service provider can be a navigational service provider, and the second service provider can be a map data service provider.

The pre-processor 214 converts the text from the text source 212 into words, identifiers, or the like. For example, where text is in numeric format, the pre-processor 214 can convert the numerals to corresponding words. In another example, where the text is punctuation, emphasized with caps, underlining, or bolding, the pre-processor 214 can convert same into output suitable for use by the synthesis engine 216 and/or unit selector 220.

The synthesis engine 216 receives the output from the text converter 214 and can arrange the output into language units that may include one or more sentences, clauses, phrases, words, subwords, and/or the like. The engine 216 may use the linguistic models 224 for assistance with coordination of most likely arrangements of the language units. The linguistic models 224 provide rules, syntax, and/or semantics in arranging the output from the text converter 214 into language units. The models 224 can also define a universe of language units the system 210 expects at any given time in any given TTS mode, and/or can provide rules, etc., governing which types of language units and/or prosody can logically follow other types of language units and/or prosody to form natural sounding speech. The language units can be comprised of phonetic equivalents, like strings of phonemes or the like, and can be in the form of phoneme HMM's.

The speech databases 218*a*, 218*b* include pre-recorded speech from one or more people. The speech can include pre-recorded sentences, clauses, phrases, words, subwords of pre-recorded words, and the like. The speech databases 218*a*, 218*b* can also include data associated with the pre-recorded speech, for example, metadata to identify recorded speech segments for use by the unit selector 220. Any suitable quantity of speech databases can be used. But in one exemplary embodiment, a first speech database 218*a* can be from the first service provider and a second speech database

218*b* can be from the second service provider. In this embodiment, one or both of the second text source 212*b* and speech database 218*b* can be an integral part of the system 210, or separately coupled to the system 210 as shown with respect to the second speech database 218*b*, and can be part of a product separate from the TTS system 210, for example, a map database product 215 from a map supplier.

The unit selector 220 compares output from the synthesis engine 216 to stored speech data and selects stored speech that best corresponds to the synthesis engine output. The speech selected by the unit selector 220 can include pre-recorded sentences, clauses, phrases, words, subwords of pre-recorded words, and/or the like. The selector 220 may use the acoustic models 226 for assistance with comparison and selection of most likely or best corresponding candidates of stored speech. The acoustic models 226 may be used in conjunction with the selector 220 to compare and contrast data of the synthesis engine output and the stored speech data, assess the magnitude of the differences or similarities therebetween, and ultimately use decision logic to identify best matching stored speech data and output corresponding recorded speech.

In general, the best matching speech data is that which has a minimum dissimilarity to, or highest probability of being, the output of the synthesis engine 216 as determined by any of various techniques known to those skilled in the art. Such techniques can include dynamic time-warping classifiers, artificial intelligence techniques, neural networks, free phoneme recognizers, and/or probabilistic pattern matchers such as Hidden Markov Model (HMM) engines. HMM engines are known to those skilled in the art for producing multiple TTS model candidates or hypotheses. The hypotheses are considered in ultimately identifying and selecting that stored speech data which represents the most probable correct interpretation of the synthesis engine output via acoustic feature analysis of the speech. More specifically, an HMM engine generates statistical models in the form of an "N-best" list of language unit hypotheses ranked according to HMM-calculated confidence values or probabilities of an observed sequence of acoustic data given one or another language units, for example, by the application of Bayes' Theorem.

In one embodiment, output from the unit selector 220 can be passed directly to the acoustic interface 228 or through the post-processor 222 without post-processing. In another embodiment, the post-processor 222 may receive the output from the unit selector 220 for further processing.

In either case, the acoustic interface 228 converts digital audio data into analog audio signals. The interface 228 can be a digital to analog conversion device, circuitry, and/or software, or the like. The loudspeaker 230 is an electroacoustic transducer that converts the analog audio signals into speech audible to a user and receivable by the microphone 32.

In one embodiment, the microphone 32 can be used to convert the speech output from the speaker 230 into electrical signals and communicate such signals to the acoustic interface 232. The acoustic interface 232 receives the analog electrical signals, which are first sampled such that values of the analog signal are captured at discrete instants of time, and are then quantized such that the amplitudes of the analog signals are converted at each sampling instant into a continuous stream of digital speech data. In other words, the acoustic interface 232 converts the analog electrical signals into digital electronic signals. The digital data are binary bits which are buffered in the memory 54 and then processed by the processor 52 or can be processed as they are initially received by the processor 52 in real-time.

Similarly, in this embodiment, the post-processor module 222 can transform continuous streams of digital speech data from the interface 232 into discrete sequences of acoustic parameters. More specifically, the processor 52 can execute the post-processor module 222 to segment the digital speech data into overlapping phonetic or acoustic frames of, for example, 10-30 ms duration. The frames correspond to acoustic subwords such as syllables, demi-syllables, phones, diphones, phonemes, or the like. The post-processor module 222 also can perform phonetic analysis to extract acoustic parametric representations from the digitized speech such as time-varying feature vectors, from within each frame. Utterances within the speech can be represented as sequences of these feature vectors. For example, and as known to those skilled in the art, feature vectors can be extracted and can include, for example, vocal pitch, energy profiles, spectral attributes, and/or cepstral coefficients that can be obtained by performing Fourier transforms of the frames and decorrelating acoustic spectra using cosine transforms. Acoustic frames and corresponding parameters covering a particular duration of speech can be stored and processed.

In a preferred embodiment, the post-processor 222 can be used to modify the stored speech in any suitable manner. For example, the stored speech can be modified so as to adapt speech recorded from one speaker to sound similar to speech recorded from another speaker, or to adapt speech recorded from a speaker in one language to sound similar to speech recorded from the same speaker in another language. The post-processor 222 can transform speech data from one speaker with the speech data from another speaker. More specifically, the post-processor 222 can extract or otherwise process cepstral acoustic features from one speaker, and conduct cepstrum analysis on those features for speaker specific characteristics of the speaker. In another example, the post-processor 222 can extract acoustic features from one speaker, and perform normalizing transformations on those features for speaker specific characteristics of the speaker. As used herein the terminology one speaker and another speaker, or two different speakers, can include two different humans speaking the same language or one human speaking two different languages.

Also in this embodiment, the post-processor 222 can be used for suitable feature filtering of speech of a second speaker. However, before such feature filtering is carried out, speaker specific characteristics of a first speaker are used to adjust one or more parameters of filter banks that are used in acoustic feature filtering of the second speaker's speech. For example, the speaker specific characteristics can be used in frequency warping of one or more filter banks that mimic a frequency scale based on a psycho-acoustic model of the human ear. More specifically, the frequency warping may include adjustment of central frequencies of mel-frequency cepstrum filter banks, changes to upper and lower cutoff frequencies of such filter banks, modification of shapes (e.g. parabolic, trapezoidal) of such filter banks, adjustment of filter gain, and/or the like. Once the filter banks have been modified, they are used to filter acoustic features from the second speaker's speech. Of course, the acoustic features filtered from the second speaker's speech are modified from what they would otherwise be without the filter bank modification and, thus, can facilitate output of adapted speech from the second speaker and/or to adapt or retrain HMM's for use in selecting or processing the second speaker's speech.

Method—

Figure 3:
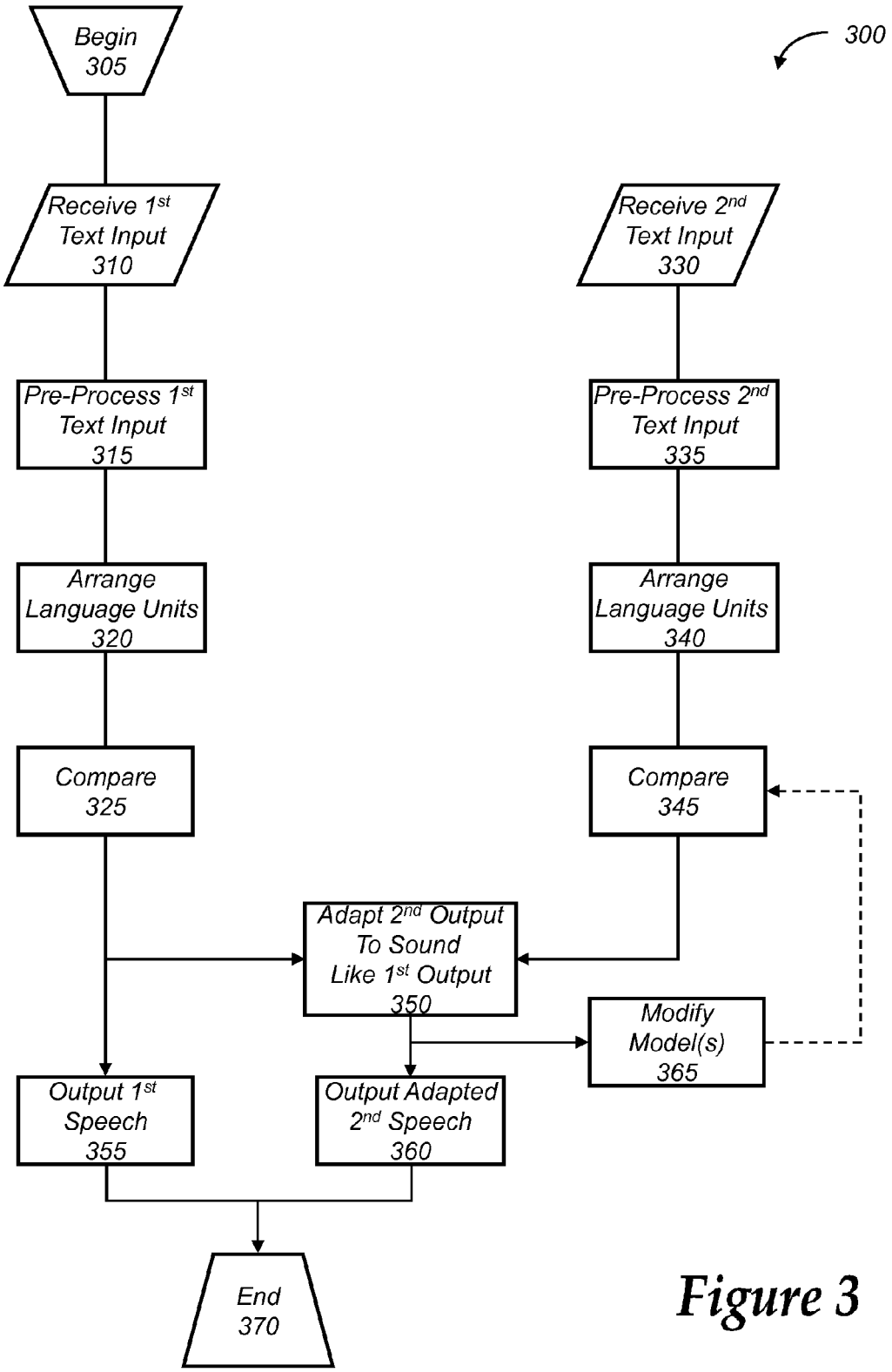
FIG. 3 is a flow chart illustrating an exemplary embodiment of a TTS method.

Turning now to FIG. 3, there is shown a speech synthesis method 300. The method 300 of FIG. 3 can be carried out using suitable programming of the TTS system 210 of FIG. 2 within the operating environment of the vehicle telematics unit 30 as well as using suitable hardware and programming of the other components shown in FIG. 1. These features of any particular implementation will be known to those skilled in the art based on the above system description and the discussion of the method described below in conjunction with the remaining figures. Those skilled in the art will also recognize that the method can be carried out using other TTS systems within other operating environments.

In general, the method 300 includes receiving first and second text inputs in a TTS system, using a system processor to process the first and second text inputs into respective first and second speech outputs corresponding to stored speech respectively from first and second speakers, and adapting the second speech output of the second speaker to sound like the first speech output of the first speaker.

Referring again to FIG. 3, the method 300 begins in any suitable manner at step 305. For example, a vehicle user starts interaction with the user interface of the telematics unit 30, preferably by depressing the user interface push-button 34 to begin a session in which the user receives TTS audio from the telematics unit 30 while operating in a TTS mode. In one exemplary embodiment, the method 300 may begin as part of a navigational routing application of the telematics unit 30.

At step 310, a first text input is received in a TTS system. For example, the first text input can include a navigational instruction from the first text source 212*a* of the TTS system 210. The navigational instruction can include a directional maneuver like IN 500' TURN RIGHT ONTO . . . .

At step 315, the first text input is pre-processed to convert the text into output suitable for speech synthesis. For example, the pre-processor 214 can convert text received from the text source 212*a* into words, identifiers, or the like for use by the synthesis engine 216. More specifically, the example navigational instruction from step 310 can be converted into "In five hundred feet, turn right onto . . . "

At step 320, the output from step 315 is arranged into language units. For example, the synthesis engine 216 can receive the output from the text converter 214 and, with the linguistic models 224, can arrange the output into language units that may include one or more sentences, clauses, phrases, words, subwords, and/or the like. The language units can be comprised of phonetic equivalents, like strings of phonemes or the like.

At step 325, language units are compared to stored data of speech, and the speech that best corresponds to the language units is selected as speech representative of the input text. For example, the unit selector 220 can use the acoustic models 228 to compare the language units output from the synthesis engine 216 to speech data stored in the first speech database 218*a* and select stored speech having associated data that best corresponds to the synthesis engine output. Together, steps 320 and 325 can constitute an example of processing or synthesizing the first text input into first speech output using stored speech from a first speaker.

At step 330, a second text input is received in a TTS system. For example, the second text input can include a navigational variable from the second text source 212*b* of the TTS system 210. The navigational variable can include a street name, like "S. M-24."

At step 335, the second text input is pre-processed to convert the text into synthesizable output or output suitable for speech synthesis. For example, the pre-processor 214 can convert text received from the second text source 212*b* into words, identifiers, or the like for use by the synthesis engine 216. More specifically, the example navigational variable from step 330 can be converted into "Southbound M Twenty Four." Together, the navigational instruction and variable can constitute a TTS sculpted prompt.

At step 340, the output from step 335 is arranged into language units. For example, the synthesis engine 216 can receive the output from the text converter 214 and, with the linguistic models 224, can arrange the output into language units that may include one or more sentences, clauses, phrases, words, subwords, and/or the like. The language units can be comprised of phonetic equivalents, like strings of phonemes or the like.

At step 345, language units are compared to stored data of speech, and the speech that best corresponds to the language units is selected as speech representative of the input text. For example, the unit selector 220 can use the acoustic models 228 to compare the language units output from the synthesis engine 216 to speech data stored in the second speech database 218*b* and select stored speech having associated data that best corresponds to the synthesis engine output. Together, steps 340 and 345 can constitute an example of processing or synthesizing the second text input into second speech output using stored speech from a second speaker.

At step 350, the second speech output of the second speaker is adapted to sound like the first speech output of the first speaker. For example, acoustic features of the first speech output can be analyzed for one or more speaker specific characteristics of the first speaker, and then an acoustic feature filter used to filter acoustic features from the second speech output can be adjusted based on the speaker specific characteristic(s) of the first speaker and, thereafter, acoustic features from the second speech output can be filtered using the adjusted filter.

In one embodiment, the filter can be adjusted by adjusting one or more parameters of a mel-frequency cepstrum filter. The parameters can include filter bank central frequencies, filter bank cutoff frequencies, filter bank bandwidths, filter bank shape, filter gain, and/or the like. The speaker specific characteristic includes at least one of vocal tract or nasal cavity related characteristics. More specifically, the characteristics can include length, shape, transfer function, formants, pitch frequency, and/or the like.

In one embodiment, the acoustic features of the first speech output can be pre-extracted from the pre-recorded speech and stored in association with that speech, for example, in the speech databases 218*a*, 218*b*. In another embodiment, the acoustic features can be extracted from the selected pre-recorded speech internally within the TTS system 210 by the post-processor 222. In a further embodiment, the acoustic features can be extracted from the selected pre-recorded speech after it has been output from the speaker 230 and received by the microphone 32 and fed back to the post-processor 222 via the interface 232. In general, acoustic feature extraction is well known to those of ordinary skill in the art, and the acoustic features can include Mel-frequency Cepstral Coefficients (MFCCs), relative spectral transform—perceptual linear prediction features (RASTA-PLP features), or any other suitable acoustic features.

At step 355, the first speech output from the first speaker is output. For example, the pre-recorded speech from the first speaker that is selected from the database 218*a* by the selector 220 can be output through the interface 228 and speaker 230.

At step 360, the adapted second speech from the second speaker is output. For example, the pre-recorded speech from the second speaker that is selected from the database 218*b* by the selector 220 and that is adapted by the post-processor 222 can be output through the interface 228 and speaker 230.

At step 365, models used in conjunction with processing the stored speech from the second speaker can be modified. For example, the acoustic models 226 can include TTS Hidden Markov Models (HMMs) that can be adapted in any suitable manner so that subsequent speech from the second speaker sounds more and more like that from the first speaker. As discussed previously herein with respect to the TTS system 210, the post-processor 222 can be used to modify stored speech in any suitable manner. As shown in dashed lines, the adapted TTS HMMs can be fed back upstream to improve selection of subsequent speech.

At step 370, the method may end in any suitable manner.

In contrast to prior techniques for outputting speech from multiple different speakers in a TTS system where the speakers voices sound different, the presently disclosed speech synthesis method is carried out so that speech from one of the speakers is adapted to sound like speech from another one of the speakers.

Although the presently disclosed method is described in conjunction with an example sculpted prompt or instruction in a navigational contexts, the method could be used in any other suitable contexts. For example, the method could be used in a hands free calling context to adapt a stored nametag to sound like an enunciated command, or vice-versa. In other examples, the method could be used in adapting instructions from different speakers in automated voice menus, speech controlled devices, or the like.

The method or parts thereof can be implemented in a computer program product including instructions carried on a computer readable medium for use by one or more processors of one or more computers to implement one or more of the method steps. The computer program product may include one or more software programs comprised of program instructions in source code, object code, executable code or other formats; one or more firmware programs; or hardware description language (HDL) files; and any program related data. The data may include data structures, look-up tables, or data in any other suitable format. The program instructions may include program modules, routines, programs, objects, components, and/or the like. The computer program can be executed on one computer or on multiple computers in communication with one another.

The program(s) can be embodied on computer readable media, which can include one or more storage devices, articles of manufacture, or the like. Exemplary computer readable media include computer system memory, e.g. RAM (random access memory), ROM (read only memory); semiconductor memory, e.g. EPROM (erasable, programmable ROM), EEPROM (electrically erasable, programmable ROM), flash memory; magnetic or optical disks or tapes; and/or the like. The computer readable medium may also include computer to computer connections, for example, when data is transferred or provided over a network or another communications connection (either wired, wireless, or a combination thereof). Any combination(s) of the above examples is also included within the scope of the computer-readable media. It is therefore to be understood that the method can be at least partially performed by any electronic articles and/or devices capable of executing instructions corresponding to one or more steps of the disclosed method.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. For example, the invention can be applied to other fields of speech signal processing, for instance, mobile telecommunications, voice over internet protocol applications, and the like. All such other embodiments, changes, and modifications are intended to come within the scope of the appended claims.

As used in this specification and claims, the terms "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A method of speech synthesis, comprising the steps of:

(a) receiving first and second text inputs, the content of which collectively forms a reply to a user request, in a text-to-speech system, wherein the first text input is obtained from one data source and the second text input is obtained from a different data source;

(b) processing the first and second text inputs into respective first and second speech outputs corresponding to stored speech respectively from first and second speakers using a processor of the system;

(c) adapting the second speech output of the second speaker to sound like the first speech output of the first speaker;

(d) outputting the first speech output of the first speaker; and (e) outputting the adapted second speech output of the second speaker, wherein the first and second speech outputs include different content and are presented sequentially to a user of the text-to-speech system.

2. The method of claim 1, wherein the first speech output is a navigational instruction and the second speech output is a navigational variable.

3. The method of claim 2, wherein the navigational instruction is a directional maneuver and the navigational variable is a street name.

4. The method of claim 1, further comprising the step of (f) modifying models used in conjunction with processing the stored speech from the second speaker.

5. The method of claim 4, wherein step (f) includes modifying Hidden Markov Models.

6. The method of claim 1, wherein step (c) includes:

(c1) analyzing acoustic features of the first speech output for at least one speaker specific characteristic of the first speaker;

(c2) adjusting an acoustic feature filter used to filter acoustic features from the second speech output, based on the at least one speaker specific characteristic of the first speaker; and (c3) filtering acoustic features from the second speech output using the filter adjusted in step (c2).

7. The method of claim 6, wherein step (c3) includes adjusting at least one parameter of a mel-frequency cepstrum filter including at least one of filter bank central frequencies, filter bank cutoff frequencies, filter bank bandwidths, filter bank shape, or filter gain.

8. The method of claim 6, wherein the at least one speaker specific characteristic includes at least one of vocal tract or nasal cavity related characteristics.

9. The method of claim 8, wherein the characteristics include at least one of length, shape, transfer function, formants, or pitch frequency.

10. A computer program product including instructions on a non-transitory computer readable medium and executable by a computer processor of a speech synthesis system to cause the system to implement steps comprising:

(a) receiving first and second text inputs, the content of which collectively replies to a user request, in a text-to-speech synthesis system, wherein the first text input is obtained from one data source and the second text input is obtained from a different data source;

(b) processing the first and second text inputs into respective first and second speech outputs corresponding to stored speech respectively from first and second speakers using a processor of the system; and (c) adapting the second speech output of the second speaker to sound like the first speech output of the first speaker;

(d) outputting the first speech output of the first speaker; and (e) outputting the adapted second speech output of the second speaker wherein the first and second speech outputs include different content and are presented sequentially to a user of the text-to-speech system.

11. The product of claim 10, wherein step (c) includes:

(c1) analyzing acoustic features of the first speech output for at least one speaker specific characteristic of the first speaker;

(c2) adjusting an acoustic feature filter used to filter acoustic features from the second speech output, based on the at least one speaker specific characteristic of the first speaker; and (c3) filtering acoustic features from the second speech output using the filter adjusted in step (c2).

12. A speech synthesis system, comprising:

a first source of text having content that replies to a user request;

a second source of text having content that replies to the user request;

a first speech database including pre-recorded speech from a first speaker;

a second speech database including pre-recorded speech from a second speaker;

a pre-processor to convert text into synthesizable output;

a processor to convert first and second text inputs from the first and second sources of text into respective first and second speech outputs corresponding to the pre-recorded speech respectively from the first and second speakers, wherein the content of the first text input and the second text input collectively forms a reply to the user request;

a post-processor to adapt the second speech output of the second speaker to sound like the first speech output of the first speaker;

an acoustic interface to convert speech output into audio signals; and a speaker to convert the audio signals to audible speech, wherein the speaker outputs the first speech output of the first speaker, and outputs the adapted second speech output of the second speaker wherein the first and second speech outputs include different content and are presented sequentially to a user of the text-to-speech system.

13. The system of claim 12, wherein the post-processor modifies models used in conjunction with processing stored speech from the second speaker.

14. The system of claim 12, wherein the post-processor analyzes acoustic features of the first speech output for at least one speaker specific characteristic of the first speaker, adjusts an acoustic feature filter used to filter acoustic features from the second speech output, based on the at least one speaker specific characteristic of the first speaker, and filters acoustic features from the second speech output using the adjust filter.

15. The system of claim 14, wherein the post-processor adjusts at least one parameter of a mel-frequency cepstrum filter including at least one of filter bank central frequencies, filter bank cutoff frequencies, filter bank bandwidths, filter bank shape, or filter gain.

16. The method of claim 1, wherein speech is output from multiple different speakers whose voices sound different, and wherein speech from one of the speakers is adapted to sound like speech from another one of the speakers to improve text to speech quality.

* * * * *